US005420935A

United States Patent [19]

Shinohara et al.

[11] Patent Number: 5,420,935

[45] Date of Patent: May 30, 1995

[54] AURICLE INSERTION HEADPHONE WITH IMPROVED GRILL

[75] Inventors: Ikuo Shinohara, Tokyo; Kenichi Katayama, Kanagawa; Koji Nageno, Tokyo, all of Japan

[73] Assignee: Sony Corporation, Tokyo, Japan

[21] Appl. No.: 189,711

[22] Filed: Feb. 1, 1994

[30] Foreign Application Priority Data

Feb. 9, 1993 [JP] Japan ..... 5-020883

[51] Int. Cl.[6] ..... H04R 25/00

[52] U.S. Cl. ..... 381/183; 381/187; 379/431

[58] Field of Search ..... 381/183, 187, 25, 68.6, 381/68, 189, 205, 188, 113, 116, 191; 379/430, 431, 432, 428; 181/128, 129, 130, 135

[56] References Cited

U.S. PATENT DOCUMENTS

| | | | |
|---|---|---|---|
| 2,293,078 | 8/1942 | Proctor | 381/189 |
| 2,346,226 | 4/1944 | Marlow | 381/189 |
| 2,423,014 | 6/1947 | Gilman | 381/189 |
| 4,058,688 | 11/1977 | Nishimura et al. | 381/183 |
| 4,429,194 | 1/1984 | Kamon et al. | 381/187 |
| 4,646,872 | 3/1987 | Kamon et al. | 381/187 |
| 4,736,435 | 4/1988 | Yokoyama et al. | 381/187 |

FOREIGN PATENT DOCUMENTS

| | | |
|---|---|---|
| 373816 | 6/1990 | European Pat. Off. . |
| 2547967 | 12/1984 | France . |
| 2220819 | 7/1988 | United Kingdom . |

*Primary Examiner*—Curtis Kuntz
*Assistant Examiner*—Huyen D. Le
*Attorney, Agent, or Firm*—Jay H. Maioli

[57] ABSTRACT

A headphone includes an electro-acoustic transducer, a housing, and first, second and third members. The electro-acoustic transducer includes a diaphragm and is supplied with a signal through a cord. The housing is shaped in such a way as to be accommodated into a concave portion of an auricle and includes an accommodating portion in which the electro-acoustic transducer is accommodated and a projecting portion for leading the cord from the inside of the housing to the outside of the housing. The accommodating portion has a first opening so that the electro-acoustic transducer is exposed to the outside from the first opening. The projecting portion is formed on the rear surface of the accommodating portion. A first member is provided so as to cover the whole surface of the diaphragm and the first opening and is made of a metal material. The first member has a plurality of first openings. A second member is provided on the first member so as to cover the first member and is made of a synthetic resin material. The second member has a plurality of second openings whose diameters are smaller than those of the first openings. A third member is attached to the housing so as to cover the housing having the second member attached at a portion in which the first opening is formed, and is made of an elastic material. The third member has a second opening which is smaller than the first opening.

8 Claims, 5 Drawing Sheets

AURICLE INSERTION HEADPHONE WITH IMPROVED GRILL

BACKGROUND

1. Field of the Invention

The present invention relates to headphones. More particularly, the present invention relates to a headphone of an auricle insertion system (so-called inner ear-type headphone) so that a housing thereof is inserted into an auricle and secured therein when the headphone is in use.

2. Background of the Invention

Headphones of so-called auricle insertion type have hitherto been proposed as described in U.S. Pat. Nos. 4,736,435, 4,429,194 and 4,646,872, for example. The conventional headphone of this auricle insertion type is arranged as shown in FIGS. 1 and 2. FIG. 1 is an exploded perspective view of such conventional headphone, and FIG. 2 is a perspective view showing the headphone shown in FIG. 1 is in its assembled state. In FIGS. 1 and 2, reference numeral 1 designates a housing. The housing 1 incorporates therein a speaker unit 3 to which signal lines 2*a*, 2*b* are connected. The speaker unit 3 is inserted from an opening portion 1*b* of the housing 1 and accommodated within the housing 1 so as to expose its diaphragm 4 from the opening portion lb. The speaker unit 3 has a small diameter, e.g., ten-odd millimeters sufficient so that it can be inserted into an auricle and secured therein. The diaphragm 4 provided in front of the speaker unit 3 is driven by a magnetic flux generated from a magnetic circuit 5 provided at the rear portion of the speaker unit 3. More specifically, the diaphragm 4 is connected with a bobbin around which there is wound a voice coil to which an audio signal is supplied via the signal lines 2*a*, 2*b*. The bobbin and the diaphragm 4 are vibrated by a cooperation of a magnetic flux generated from a magnet provided within the magnetic circuit 5 disposed near the voice coil and an alternating magnetic flux generated by the voice coil on the basis of the audio signal supplied to the voice coil.

The two signal lines 2*a*, 2*b* are led out from a projecting portion 1*a* formed at the rear portion of the housing 1 as a single signal line 2. To the end portion of the signal line 2 is connected a plug (not shown) that is inserted into a headphone jack serving as an audio signal source. Although FIG. 1 or 2 shows only one headphone, a stereophonic-type headphone needs a pair of right and left headphones, each of which has the housing 1 thus arranged.

With the above-mentioned structure, a reproduced sound is radiated forwardly on the basis of the vibration of the diaphragm 4 of the speaker unit 3. A protector 6 having a number of apertures 6*a* of relatively large diameters is disposed so as to wholly cover the front surface of the diaphragm 4. This protector 6 is formed of a plate-shaped member having a relatively large strength, such as a stainless steel plate or the like to protect the diaphragm 4 or the like from being damaged when a pressure is applied thereto from the outside.

A grill 7 is disposed on the front surface of the protector 6. The grill 7 is made by forming a metal mesh of metal wires into a curved circular mesh structure by a press work. The grill 7 is disposed on the front surface of the protector 6 in order to prevent the speaker unit 3 from being smudged by dusts or the like entered from the outside.

A rubber ring 8 covers the headphone from the grill 7 to the housing 1. The rubber ring 8 has an opening portion 8*a* bored through its predetermined position so that, when this headphone is assembled as a product, the grill 7 is exposed only from this opening portion 8*a*. A reproduced sound is output from this opening portion 8*a*. The rubber ring 8 is provided in order to prevent the reproduced sound output from the headphone from being leaked to the outside of an auricle, i.e., to prevent a so-called sound leakage. The opening portion 8*a* is smaller than the opening portion 1*b* of the housing 1.

The reason that the grill made by treating the metal mesh by the press work is used as the grill 7 attached to the headphone is that the grill 7 thus formed has small meshes and is excellent in dust proof property. As a consequence, the headphone of this auricle insertion type can be reduced in thickness and can satisfactorily be used.

However, such grill made by treating the metal mesh by the press work is expensive and needs much time and labor when such grill is processed. More specifically, the expensive metal mesh in which metal wires are formed as a mesh structure is used as a material and much time and labor are required to form this metal mesh material into the curved circular grill by the press work. Particularly, when the metal mesh is cut into a circular grill, it is frequently observed that metal wires around the edge of the curved circular grill become loose. Therefore, it is unavoidable that a defectiveness of a fraction of the grill is increased.

SUMMARY OF THE INVENTION

It is, therefore, an object of the present invention to provide a headphone which can solve the above-mentioned problems.

According to an aspect of the present invention, there is provided a headphone which includes a housing, an electro-acoustic transducer, and first and second members. The housing has an opening and a projecting portion. The projecting portion lead out a cord from the inside of the housing to the outside of the housing. The electro-acoustic transducer is connected to the cord. The electro-acoustic transducer has a diaphragm and is housed in the housing to expose the diaphragm through the opening. The first member is provided on the electro-acoustic transducer to cover and protect the diaphragm. The first member is formed of a plurality of first openings. The second member is provided on the opening so as to cover the first member. The second member is formed of a plurality of second openings. The .diameters of the second openings are smaller than those of the first openings.

According to the present invention, since the grill which is attached to the first member provided so as to cover the diaphragm of the electro-acoustic transducer and which serves as the second member having a plurality of openings is made of a synthetic resin material, the number of defects of the grill itself can be reduced. Furthermore, the manufacturing cost of the headphone can be reduced.

BRIEF DESCRIPTION OF THE DRAWINGS

The present invention will be readily understood with reference-to the accompanying drawings, wherein:

FIGS. 6A through 6D are respectively diagrams used to explain manufacturing processes of a grill according to the present invention, wherein FIG. 6A shows a synthetic resin plate which serves as a material for grill, FIG. 6B shows a synthetic resin plate that was processed by punching, FIG. 6C shows the synthetic resin plate on which the projecting portions are formed, and FIGURE 6D shows completed grills.

DESCRIPTION OF THE INVENTION

Figure 1:
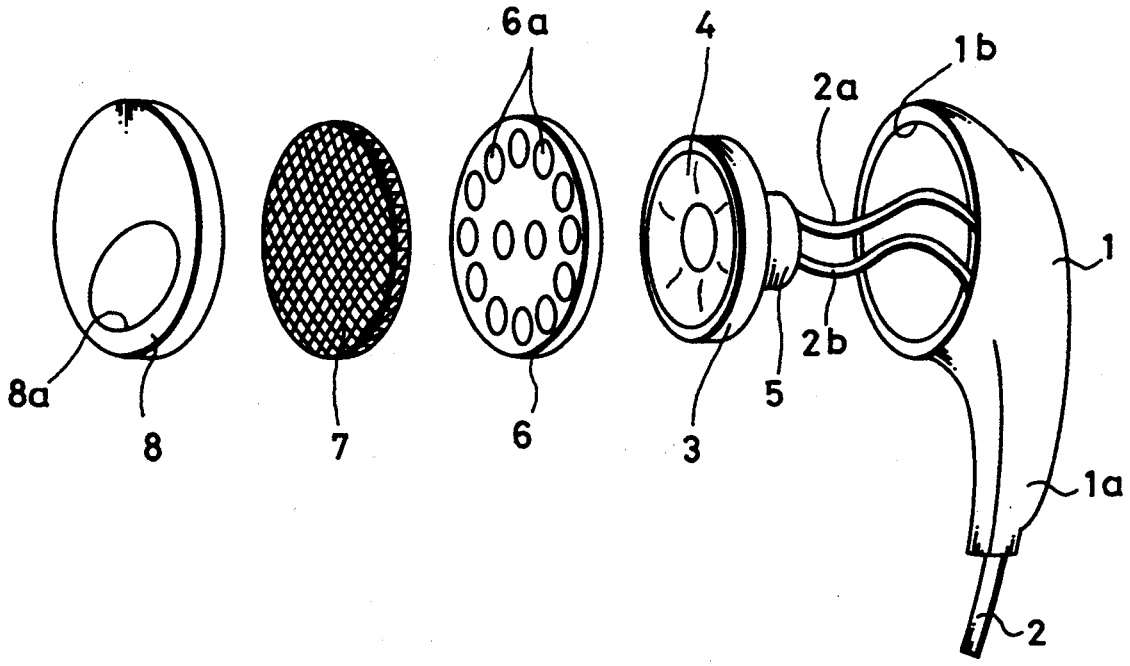
FIGURE 1 (PRIOR ART)
FIG. 1 is an exploded perspective view showing a structure of a conventional headphone.
Figure 2:
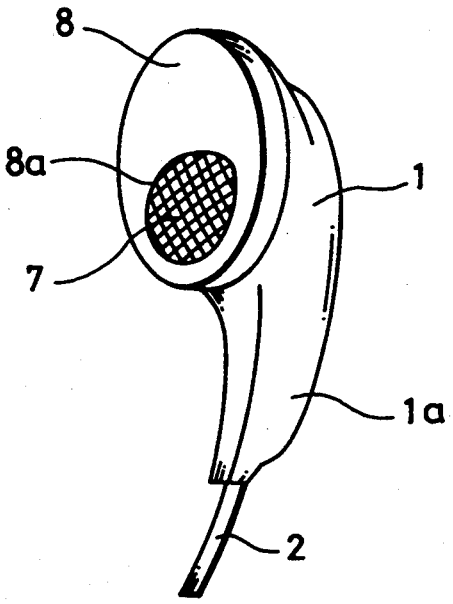
FIGURE 2 (PRIOR ART)
FIG. 2 is a perspective view showing the structure of the conventional headphone shown in FIG. 1.
Figure 3:
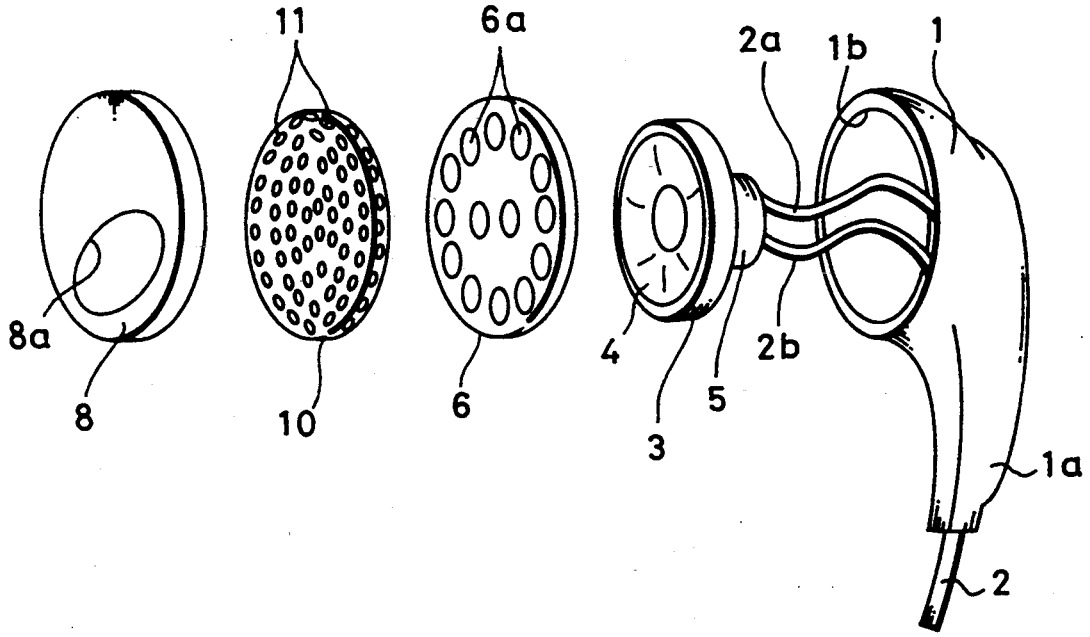
FIG. 3 is an exploded perspective view showing a headphone according to an embodiment of the present invention.

A headphone according to an embodiment of the present invention will hereinafter be described with reference to FIGURES 3, 4, 5 and FIGS. 6A to 6D. In FIGS. 3, 4, 5 and FIGS. 6A, 6B, like parts corresponding to those of FIGS. 1 and 2 are marked with the same references and therefore need not be described in detail.

In this embodiment, the headphone according to the present invention is applied to the headphone of the auricle insertion system. In this embodiment, a grill that is attached to this headphone is made of a synthetic resin instead of the conventional metal mesh. A manufacturing process of this grill will be described with reference to FIGS. 6A through 6D.

Figure 6A:
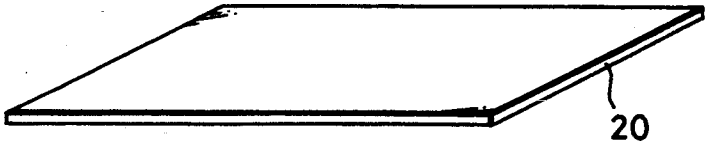
Figure 6B:
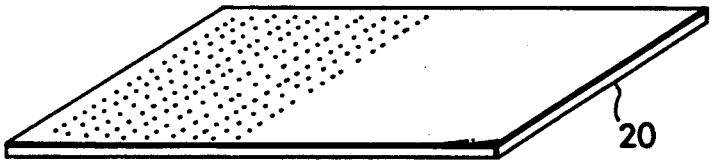

Initially, there is prepared a synthetic resin plate 20 having a thickness of about 0.3 [mm] as shown in FIG. 6A. This synthetic resin plate 20 might be formed of a resin material, such as a hard vinyl chloride, ABS (acrylonitrile butadiene styrene) resin, polyethylene terephthalate resin or the like. Then, as shown in FIG. 6B, a plurality of very small apertures are sequentially bored through this synthetic resin plate 20 by the punching process in which apertures are punched by using mold pins. In this embodiment, apertures having a diameter of 0.5 [mm], for example, are bored through the whole surface of the synthetic resin plate 20 at a pitch of 0.65 [mm] with substantially a uniform interval.

Figure 6C:
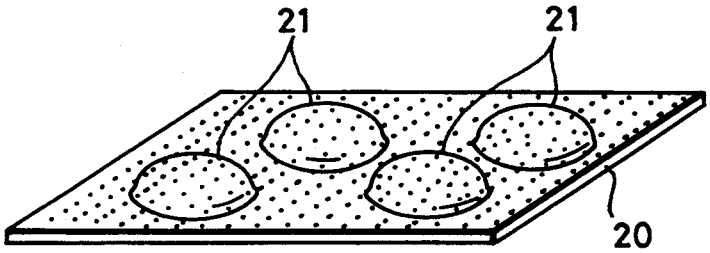
Figure 6D:
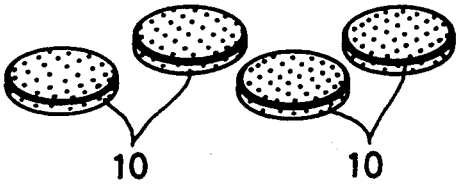

As shown in FIG. 6C, a plurality of curved projecting portions 21 are formed by molding the synthetic resin plate 20 having the apertures bored therethrough by punching using a predetermined mold, i.e., mold corresponding to the shape of the grill under heating. Then, as shown in FIG. 6D, grills 10 are formed by cutting the respective projecting portions 21 in a circular fashion.

Figure 4:
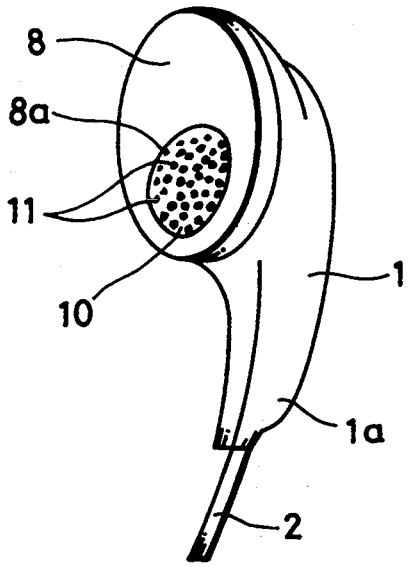
FIG. 4 is a perspective view showing the headphone according to the embodiment of the present invention.
Figure 5:
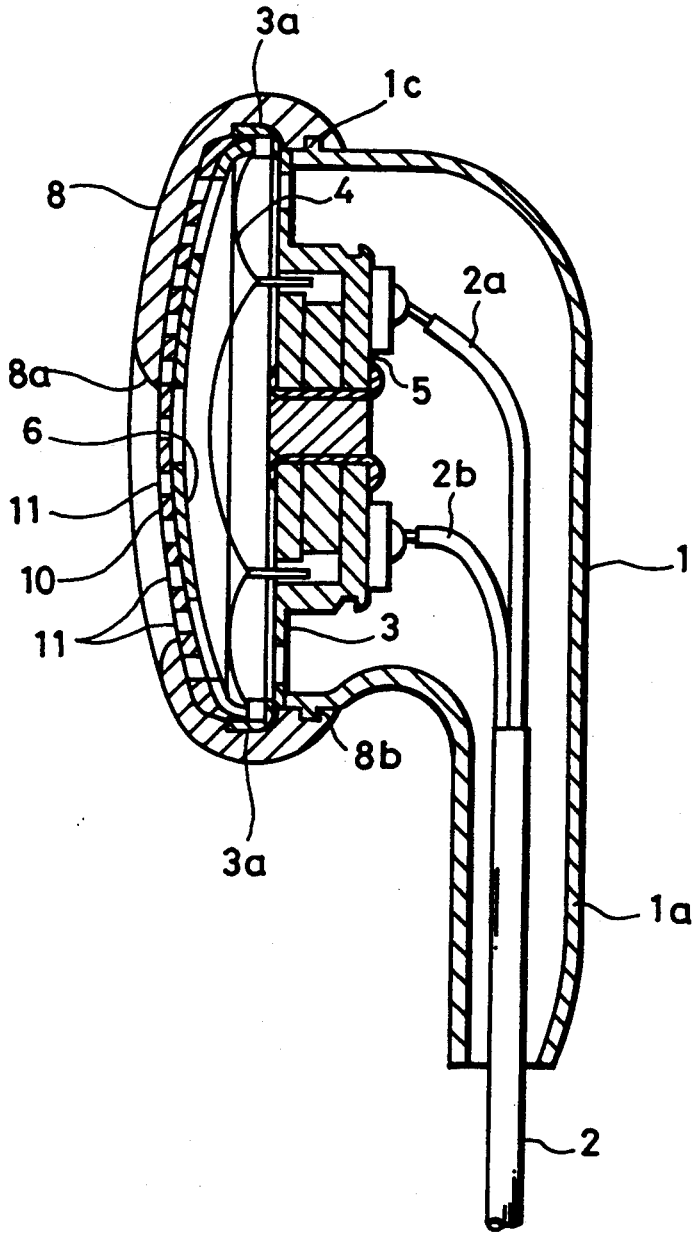
FIG. 5 is a cross-sectional view showing the headphone according to the embodiment of the present invention.

The grill 10 thus formed is attached to the headphone as follows. The housing 1 incorporates therein the speaker unit 3 as shown in FIG. 5. A protector 6 is attached to the front surface side of the speaker unit 3 in order to protect the diaphragm 4 of the speaker unit 3. The protector 6 has a plurality of apertures **6*a* whose diameters are larger than those of the apertures 11 bored through the grill 10 by punching. The grill 10 is fitted into the front surface side of the protector 6. The grill 10 is fixed to the frame 3*a* of the speaker unit 3 by some suitable means, such as an adhesive or the like. A rubber ring 8 is attached to the housing 1 so as to cover the whole surface of the grill 10 and the housing 1 at its front surface side in which the opening portion 1*b* is formed under the condition that the grill 10 is attached to the frame 3*a* of the speaker unit 3. The rubber ring 8 is attached to the housing 1 by engagement between a concave portion 8*b* formed on the inner peripheral side of the rubber ring 8 and a projecting portion 1*c* formed on the outer periphery of the housing 1. When the headphone is assembled, as shown in FIG. 4, the apertures 11 on the grill 10 are exposed to the outside from the opening portion 8*a* of the rubber ring 8**.

According to the embodiment of the present invention, since the synthetic resin plate having a plurality of very small apertures bored therethrough by punching is molded by the press-treatment and used as the grill 10, the grill having satisfactory shape can be manufactured by a simple process with a small number of defects. The apertures that are formed by punching are very small in, diameter unlike the case that apertures are formed by the injection molding process of a synthetic resin or the like. Such apertures that are formed by punching can achieve a dust proof effect similar to that achieved by the metal mesh and can be considerably reduced in thickness. Therefore, the headphone of the auricle insertion type according to the present invention can be prevented from being increased in thickness as compared with the conventional headphone of auricle insertion type. Also, the headphone according to the present invention can satisfactorily be used. Moreover, disadvantages in the manufacturing process, such as a frayed edge of the grill formed by the metal mesh, can be removed and the headphone according to the present invention can be manufactured with a simple process with a small number of defects. The manufacturing cost of the headphone can be reduced by using the grill according to the embodiment of the present invention. With the employment of the grill according to this embodiment, the metal parts can be prevented from being exposed on the sound radiation portion of the headphone. Therefore, the headphone according to this embodiment can satisfactorily be used by users who have problems with the skin because of contact with metals, i.e., those who are allergic to metals.

Figure 7:
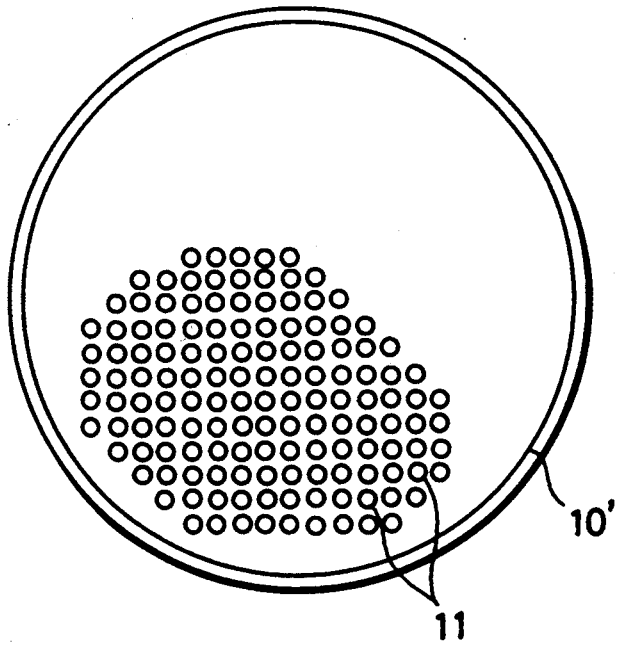
FIG. 7 is a diagram showing a modified example of the grill according to the present invention.

While the apertures are bored through the whole surface of the grill at the uniform interval as described above, the present invention is not limited ! thereto and the apertures may be bored therethrough at irregular intervals. As shown in FIG. 7, for example, it is possible to form a grill 10' having apertures 11 concentrated at a portion corresponding to the opening portion **8*a* of the rubber ring 8. Alternatively, considering playback characteristics of the reproduced sound, the apertures 11** may be disposed at irregular intervals in order to obtain satisfactory playback characteristics. In this case, apertures which are different in diameter may be disposed on the grill.

Further, while the thin synthetic resin plate is processed and used as the grill as described above, the present invention is not limited thereto and the following variant also is possible. That is, a plurality of very small apertures may be bored through a thinner resin film having a thickness of about 50 [mm] by punching and then this thinner resin film may be molded as a grill of a predetermined shape by a press-treatment.

Furthermore, while the present invention is applied to the headphone in which the rubber ring is attached to the front surface of the grill as described above, the present invention is not limited thereto and may be applied to a headphone of the shape such that the grill is directly exposed without the rubber ring.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A headphone comprising:

a housing having a first opening and a holding portion, said holding portion holding a cord;

an electro-acoustic transducer connected to said cord, said electro-acoustic transducer having a diaphragm and being housed in said housing to expose said diaphragm from said first opening;

a first member being provided on said electro, acoustic transducer and being formed with a plurality of first apertures;

a second member provided on said opening so as to cover said first member, said second member being made of a synthetic resin and having a plurality of second apertures; and a third member provided on said housing so as to cover said first opening, said third member being made of an elastic material and having a second opening formed therethrough.

2. A headphone according to claim 1, wherein said plurality of second apertures are provided at irregular intervals.

3. A headphone according to claim 2, wherein said diameters of said plurality of second apertures comprise a plurality of diameters of differing size.

4. A headphone according to claim 1, wherein said plurality of second apertures are provided at uniform intervals.

5. A headphone comprising:

a housing having an accommodating portion shaped in such a way as to be accommodated in a concave portion of an auricle and a projecting portion connected to said accommodating portion, said projecting portion leading out a cord from an inside of said housing to an outside of said housing, said accommodating portion having a first opening, and said projecting portion being formed on a rear surface of said accommodating portion;

an electro-acoustic transducer having a diaphragm, wherein said cord is connected to said electro-acoustic transducer add a signal is input to said electro-acoustic transducer through said cord, said electro-acoustic transducer being accommodated in said accommodating portion so that said diaphragm is exposed to the outside through said first opening;

a first member being made of a metal material and covering a whole surface of said diaphragm and said first opening, said first member having a plurality of circular first apertures;

a second member being provided on said first member so as to cover said first member and being made of a synthetic resin material, said second member having a plurality of circular second apertures having diameters smaller than diameters of said plurality of first apertures formed in said first member; and a third member being provided on said housing so as to cover said housing at a position corresponding to said first opening, said third member having a second opening smaller than said first opening.

6. A headphone according to claim 5, wherein said plurality of second apertures are provided at uniform intervals.

7. A headphone according to claim 5, wherein said plurality of second apertures are provided at irregular intervals.

8. A headphone according to claim 7, wherein said diameters of said plurality of second apertures comprise a plurality of diameters of differing size.

* * * * *